US007090594B2

(12) United States Patent
Kawashima et al.

(10) Patent No.: US 7,090,594 B2
(45) Date of Patent: Aug. 15, 2006

(54) ATTACHMENT FOR GOLF TEE

(75) Inventors: Haruo Kawashima, Tokyo (JP); Hiromasa Sato, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 11/064,846

(22) Filed: Feb. 25, 2005

(65) Prior Publication Data

US 2005/0187041 A1 Aug. 25, 2005

(30) Foreign Application Priority Data

Feb. 25, 2004 (JP) ..... 2004-050223

(51) Int. Cl.
*A63B 57/00* (2006.01)

(52) U.S. Cl. ..... 473/396; 473/400

(58) Field of Classification Search ..... 473/386–403
See application file for complete search history.

(56) References Cited

U.S. PATENT DOCUMENTS 1,573,911 A * 2/1926 Budrow ..... 473/396
3,414,268 A * 12/1968 Chase ..... 473/396
3,473,812 A * 10/1969 Pelzmann ..... 473/396

FOREIGN PATENT DOCUMENTS

| | | | | |
|---|---|---|---|---|
| FR | 1167819 | * | 12/1958 | ..... 273/33 |
| GB | 236132 | * | 7/1925 | ..... 273/33 |
| GB | 445026 | * | 4/1936 | ..... 273/211 |
| JP | 4-189374 | | 7/1992 | |
| JP | 404189374 | * | 7/1992 | ..... 273/211 |

* cited by examiner

*Primary Examiner*—Steven Wong
(74) *Attorney, Agent, or Firm*—Clark & Brody

(57) ABSTRACT

Here is disclosed an attachment for a golf tee improved to support a golf ball above a top face of the golf tee. An attachment constructed to be mounted on a head of a golf tee has a first annular segment having a generally inverted cone shape that is cut off at the top and adapted to be close round a peripheral surface of the head of the golf tee, a cylindrical second annular segment extending downward from a lower end of the first annular segment for partially surrounding a leg of the golf tee, and an elastically deformable supporting segment extending upward from an upper end of the first annular segment so as to support the golf ball with an upper distal end thereof. The first annular segment is formed with elastically deformable tongues and each of these tongues is formed on an inner surface thereof with a salience adapted to come in contact with a top face of the golf tee from above.

3 Claims, 3 Drawing Sheets

ATTACHMENT FOR GOLF TEE

BACKGROUND OF THE INVENTION

The present invention relates to an attachment used in combination with a golf tee to support a golf ball.

Conventional woody or plastic tees from which golf balls are driven off typically comprise a generally inverted cone-shaped head and a leg extending downward from a lower end of the head so that the leg may be fixed into the ground and the golf ball may be placed on the head immediately before the golf ball is driven from the tee. The golf tee disclosed in Japanese Unexamined Patent Application Publication No. 1992-189374 (hereinafter referred to as "Citation") comprises a support column member destined to be fixed in the ground, a seat member adapted to be engaged with a top of the support column member and a plurality of supporting arms arranged along a circumference of the seat member and functioning as springs. According to the disclosure of Citation, this golf tee advantageously limits a total area over which the golf ball rests in contact with the supporting arms to upper ends of the respective supporting arms and thereby remarkably alleviates a contact resistance exerted by the golf tee upon the golf ball at the moment of driving off. Correspondingly, carry of the golf ball is improved.

In the case of the golf tee disclosed in Citation, the support column member is formed on an outer peripheral surface thereof with a groove extending in the circumferential direction and the seat member is formed on an inner peripheral surface thereof with a ridge extending in the circumferential direction. The support column member is integrated with the seat member by forcibly engaging the ridge with the groove. Consequentially, such seat member adapted to be combined with the support column member in this manner can not be used with the commercially available golf tees.

SUMMARY OF THE INVENTION

It is an object of the present invention to provide an attachment adapted to be combined with various commercially available golf tees and to support a golf ball above an golf tee itself over a contact area substantially smaller than a contact area possibly required to support the golf ball directly by the golf tee.

According to the present invention, there is provided an attachment used in combination with a golf tee comprising a head substantially inverted cone-shape so as to define a circular top face and a leg extending downward from a lower end of the head and having a diameter smaller than a diameter of the top face wherein the attachment is fixed on the head and supports a golf ball above the top face.

The attachment according to the present invention comprises the attachment being composed of a first annular segment having a generally inverted cone shape that is cut off at a top thereof and adapted to be close round a peripheral surface of the head, a substantially cylindrical second annular segment extending downward from a lower end of the first annular segment so as to surround a part of the leg and an elastically deformable supporting segment extending upward from an upper end of the first annular segment so that the golf ball is placed on an upper end thereof; and the first annular segment having a peripheral wall defining an inner surface opposed to a peripheral surface of the head and an outer surface opposed to the inner surface, the peripheral wall being formed with a plurality of tongues intermittently arranged in a circumferential direction of the first annular segment each extending downward from an upper part toward an lower part of the first annular segment and being elastically deformable in a direction from the inner surface toward the outer surface, and each of the tongues being formed on an inner surface thereof with a salience extending inward with respect to the first annular segment, the salience being adapted to come in contact with an peripheral edge of the top face from above and to move outward away from the peripheral edge as each of the tongues is elastically deformed in the direction from the inner surface toward the outer surface.

The attachment according to the invention may be put together with the golf tee by inserting the leg of the golf tee into the second annular segment through the first annular segment. In the course of such insertion, the head of the golf tee impinges against the saliences of the respective tongues formed on the first annular segment and thereby elastically deforms the tongues outward away from the first annular segment until the head is completely entrapped within the first annular segment. Thereupon, the tongues elastically restore the respective initial positions and the saliences are brought into contact with peripheral edge of the golf tee's head from above. In this situation, the attachment ensures the supporting segment extending upward from the first annular segment to support the golf ball above the head of the golf tee. In addition, the saliences of the respective tongues are responsive to movement of the golf tee in the direction opposite to the direction of insertion of impinge against the head and thereby to prevent the golf tee from being disassembled from the attachment.

According to one preferred embodiment of the present invention, the first annular segment is formed with a plurality of slits extending through the peripheral wall from the inner surface to the outer surface and arranged intermittently in the circumferential direction of the first annular segment.

The attachment according to this preferred embodiment facilitates the first annular segment to be elastically deformed as the golf tee is inserted into the attachment even if the diameter of the golf tee's head is somewhat larger than the inner diameter of the first annular segment. Consequently, the attachment according to this embodiment can easily entrap the golf tee's head.

According to another preferred embodiment of the present invention, the supporting segment comprises a plurality of needle-like saliences arranged intermittently in the circumferential direction of the first annular segment and extending upward from the first annular segment.

The attachment according to this preferred embodiment advantageously reduces the contact area between the supporting segment and the golf ball because of the supporting segment for the golf ball comprising a plurality of the needle-like saliences adapted to support the golf ball in a so-called pin-point fashion.

PREFERRED EMBODIMENTS OF THE INVENTION

Details of an attachment for gold tee according to the present invention will be more fully understood from the following description given hereunder with reference to the accompanying drawings.

Figure 1:
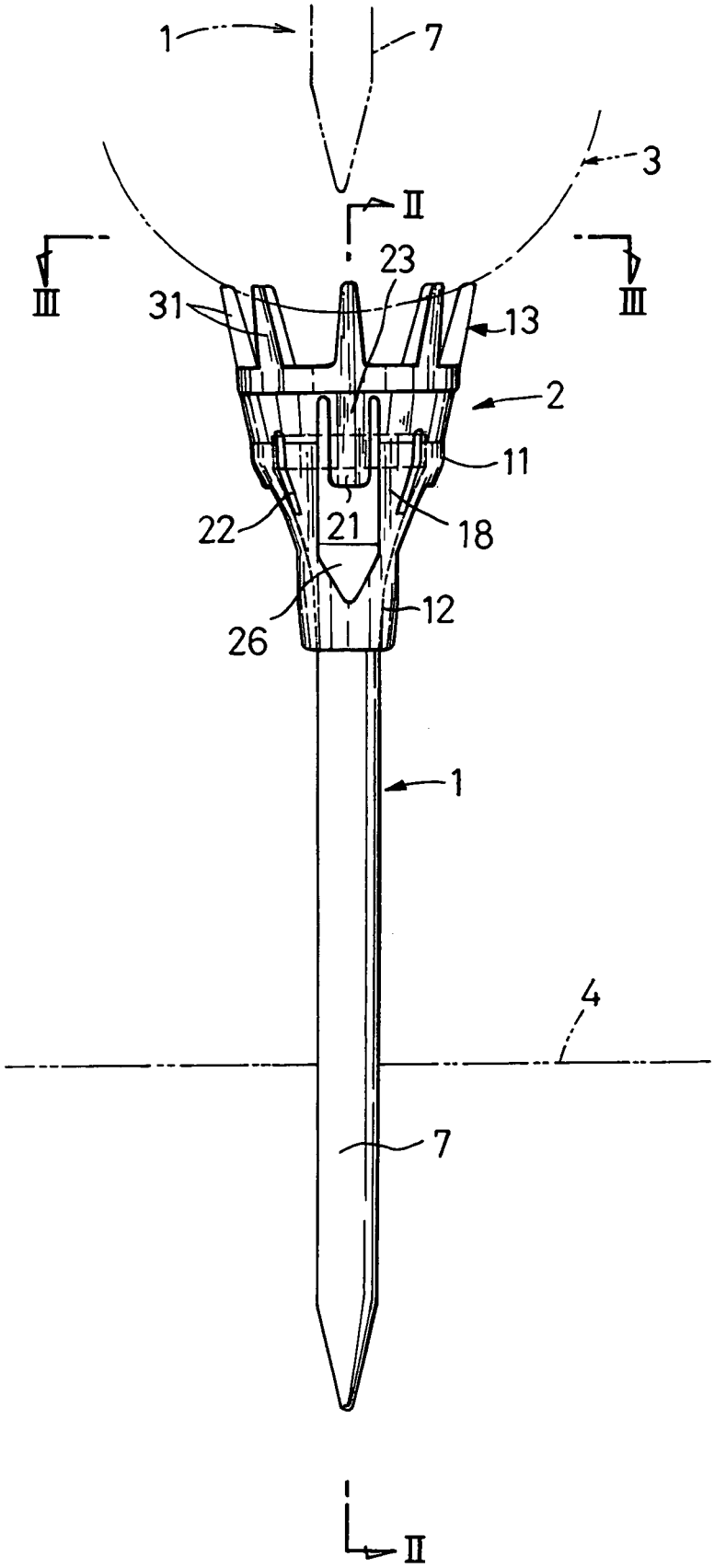
FIG. 1 is a side view showing an attachment according to the present invention during practical use.
Figure 2:
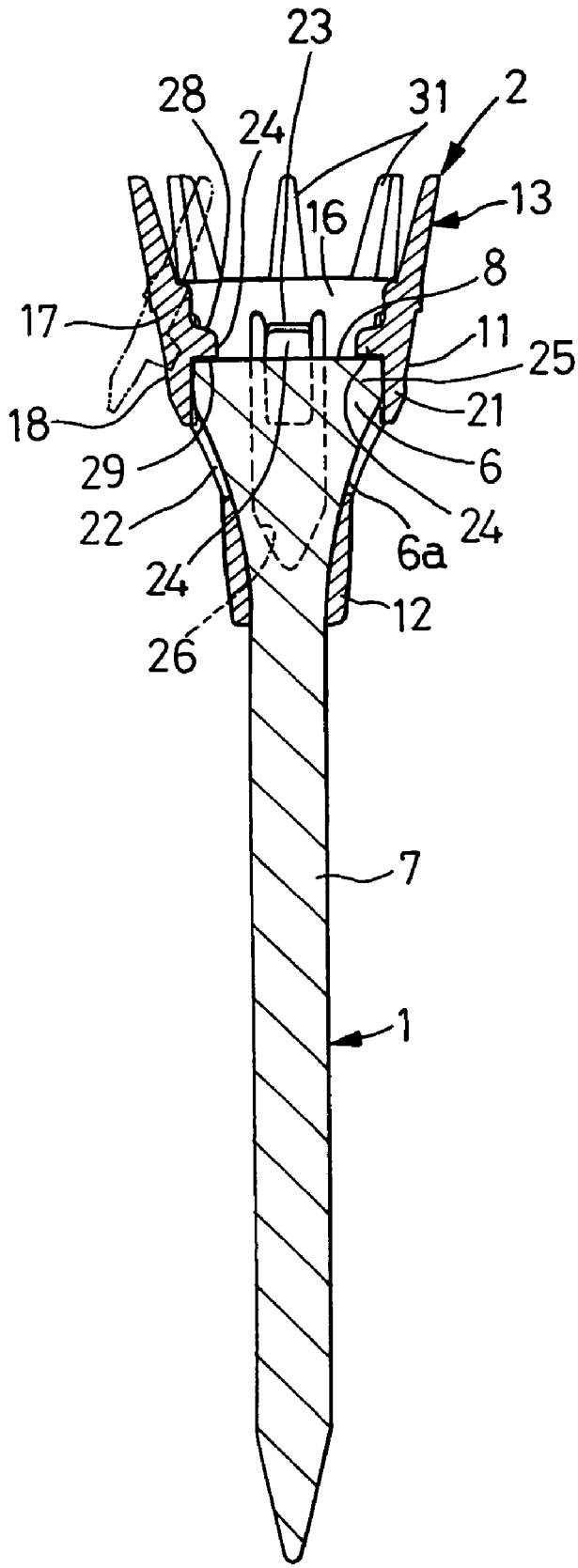
FIG. 2 is a sectional view taken along the line II—II in FIG. 1.
Figure 3:
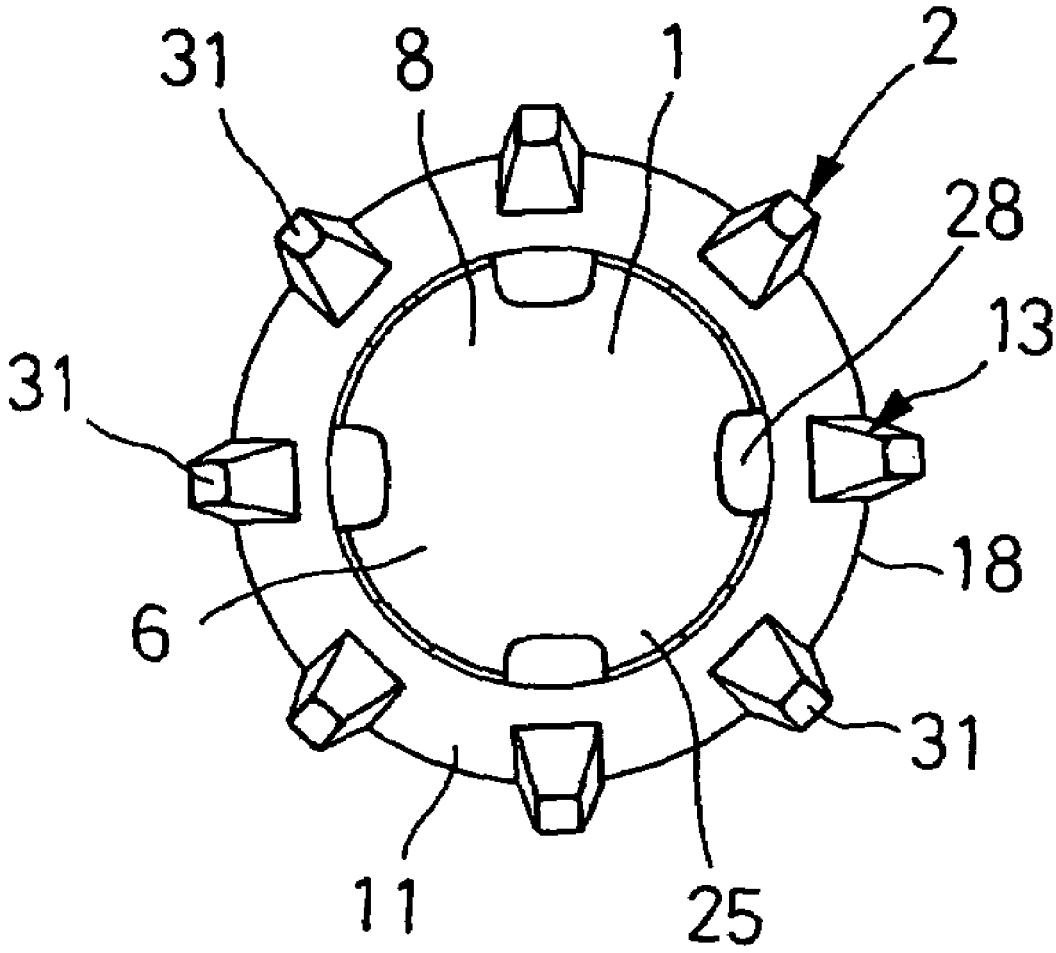
FIG. 3 is a sectional view taken along the line III—III in FIG. 1.

FIG. 1 is a side view showing an attachment 1 mounted on a golf tee 1, and FIGS. 2 and 3 are sectional views taken along lines II—II and II–III in this side view, respectively. In FIG. 1, a golf ball 3 and the ground 4 into which the golf tee 1 is fixed are indicated by imaginary lines.

The golf tee 1 is made of wood or plastic similarly to the commercially available products and basically comprises a head 6 shaped in an inverted cone and a column-shaped leg 7 extending downward from a lower end of the head 6. The head 6 has a top face 8 having a circular planar shape. The leg 7 has a diameter smaller than a diameter of the head 6 at a level of its top face 8 and has a lower end sharpened so that the leg 7 can be easily fixed in the ground 4.

The attachment 2 has a first annular segment 11 adapted to be close round a peripheral surface 6*a* of the head 6 of the golf tee 1, a cylindrical second annular segment 12 extending downward from a lower end of the first annular segment 11 and a supporting segment 13 extending upward from an upper end of the first annular segment 11. The first annular segment 11 has a slanting peripheral wall 18 defining an inner surface 16 opposed to the head 6 of the golf tee 1 and an outer surface 17 opposed to this inner surface 16. This peripheral wall 18 is formed with tongues 21 and slits 22. More specifically, the peripheral wall 18 is formed with four tongues 21 circumferentially spaced apart one from another by an angle of 90°, wherein each of these tongues 21 extends downward from its proximal end 23 located in the vicinity of the upper end of the peripheral wall 18 and has a salience 24 extending inward with respect to the first annular segment 11. The peripheral wall 18 is further formed with through-holes 26 each defined by cutting away the peripheral wall 18 around each of the tongues 21. Such first annular segment 11 is shaped like an inverted cone that is cut off at the top or a funnel so as to fit around the head 6 of the golf tee 1. The first annular segment 11 is preferably constructed so that the head 6 of the golf tee 1 may come in contact with the inner surface 16 of the slanting peripheral wall 18 on the way of the funnel-shaped slope. The saliences 24 of the respective tongues 21 are formed so that these saliences 24 may directly overlie the top face 8 of the golf tee 1 inserted into the first annular segment 11 along a peripheral edge 25 of the top face 8. Each of these saliences 24 has an upper surface 28 defining a slope down toward the inner side of the first annular segment 11 and a lower surface 29 defining substantially horizontal plane. Each slits 22 is formed between each pair of the adjacent tongues 21, 21 and extends in a vertical direction.

The second annular segment 12 has an inner diameter slightly larger than a diameter the leg 7 of the golf tee 1 has.

The supporting segment 13 includes eight needle-like saliences 31 spaced apart one from another by an angle of 45° and extending upward in a radial direction so that the golf ball 3 may be supported by distal ends of these saliences 31 in a pin-point fashion.

The attachment 2 constructed as has been described above operates in a manner as follows. First, the leg 7 of the golf tee 1 indicated by the imaginary line in FIG. 1 is inserted into the second annular segment 12 from above as viewed in FIG. 1. The peripheral edge 25 of the head 6 is pressed against the upper surfaces 28 of the respective saliences 24 as the peripheral edge 25 of the head 6 is forcibly inserted into the first annular segment 11. Consequentially, the tongues 21 are elastically deformed until the tongues 21 move outward as indicated by imaginary line in FIG. 2 in order that the head 6 can be completely entrapped within the first annular segment 11. With the head 6 entrapped within the first annular segment 11 as shown in FIG. 2, the tongues 21 elastically restores the respective initial positions as indicated by imaginary line and the saliences 24 correspondingly restore the respective initial positions directly overlying the peripheral edge 25. The attachment 2 combined with the golf tee 1 in this manner 2 allows the peripheral wall 18 of the first annular segment 11 to come in partial contact with the head 6 of the golf tee 1 from below, on one hand, and allows the saliences 24 of the first annular segment 11 also to come in contact with the head 6 of the golf tee 1 from above, on the other hand. Such a unique construction is effective to eliminate an anxiety that these two components 1, 2 might be readily disassembled from each other. Furthermore, the attachment 2 circumferentially covers the head 6 of the golf tee 1 as well as a part of the leg 7. Such an arrangement also is effective to prevent the attachment 2 from being readily disassembled from the head 6 even under a high impact given by a golf club hitting the golf ball. This impact merely results in elastic deformation of the needle-like saliences 31.

While the effect as has been described above can be achieved so far as at least the needle-like saliences 31 and the tongues 21 are elastically deformable, it is preferred to form the attachment 2 as a whole from an elastically deformable material such as rubber or plastic. The slits 22 formed through the peripheral wall 18 of the attachment 2 not only facilitate the peripheral wall 18 to be elastically deformed but also facilitate operation of inserting the head 6 of the golf tee 1 into the first annular segment 11. It should be understood that the present invention may be implemented also in the form of the attachment having none of the slits 22. In addition, the number of the tongues 21 as well as the number of the needle-like saliences 31 is not limited to those in the embodiment shown in the accompanying drawings and the attachment 2 may have the number of the tongues 21 and/or the needle-like saliences 31 different from those in the illustrated embodiment without departing from the scope of the present invention. Furthermore, the supporting member 13 may be implemented in the form of an annular member, instead of being formed by a plurality of the needle-like saliences 31.

The present invention simplifies production of the attachment adapted to be used in combination with the commercially available golf tee.

What is claimed is:

1. An attachment used in combination with a golf tee comprising:

a head having a substantially inverted cone-shape so as to define a circular top face and a leg extending downward from a lower end of said head and having a diameter smaller than a diameter of said top face wherein said attachment is fixed on said head and supports a golf ball above said top face;

said attachment being composed of a first annular segment having a generally inverted cone shape that is cut off at a top thereof and adapted to be close round a peripheral surface of said head, a substantially cylindrical second annular segment extending downward from a lower end of said first annular segment so as to surround a part of said leg and an elastically deformable supporting segment extending upward from an upper end of said first annular segment so that said golf ball is placed on upper end thereof; and said first annular segment having a peripheral wall defining an inner surface opposed to a peripheral surface of said head and an outer surface opposed to said inner surface, said peripheral wall being formed with a plurality of tongues intermittently arranged in a circumferential direction of said first annular segment each extending downward from an upper part toward an lower part of said first annular segment and being elastically deformable in a direction from said inner surface toward said outer surface, and each of said tongues being formed on an inner surface thereof with a salience extending inward with respect to said first annular segment, said salience being adapted to come in contact with an peripheral edge of said top face from above and to move outward away from said peripheral edge as each of said tongues is elastically deformed in said direction from said inner surface toward said outer surface.

2. The attachment as defined by claim 1, wherein said first annular segment is formed with a plurality of slits extending through said peripheral wall from said inner surface to said outer surface and arranged intermittently in the circumferential direction of said first annular segment.

3. The attachment as defined by claim 1, wherein said supporting segment comprises a plurality of needle-like saliences arranged intermittently in the circumferential direction of said first annular segment and extending upward from said first annular segment.

* * * * *